US008106879B2

(12) United States Patent
Huang

(10) Patent No.: US 8,106,879 B2
(45) Date of Patent: Jan. 31, 2012

(54) BACKLIGHT CONTROL CIRCUIT

(75) Inventor: Shun-Ming Huang, Shenzhen (CN)

(73) Assignees: Innocom Technology (Shenzhen) Co., Ltd., Shenzhen, Guangdong Province (CN); Chimei Innolux Corporation, Miao-Li County (TW)

( * ) Notice: Subject to any disclaimer, the term of this patent is extended or adjusted under 35 U.S.C. 154(b) by 736 days.

(21) Appl. No.: 12/228,022

(22) Filed: Aug. 8, 2008

(65) Prior Publication Data

US 2009/0039801 A1 Feb. 12, 2009

(30) Foreign Application Priority Data

Aug. 8, 2007 (CN) ..... 2007 1 0075631

(51) Int. Cl.
*G09G 3/30* (2006.01)

(52) U.S. Cl. ..... 345/102; 315/292

(58) Field of Classification Search ..... 315/292; 345/311, 312, 77, 147, 102
See application file for complete search history.

(56) References Cited

U.S. PATENT DOCUMENTS

| | | | | |
|---|---|---|---|---|
| 4,029,991 | A * | 6/1977 | Schultz | 315/135 |
| 6,570,347 | B2 | 5/2003 | Kastner | |
| 2004/0032241 | A1 * | 2/2004 | Khalili | 323/282 |
| 2006/0023002 | A1 | 2/2006 | Hara et al. | |

FOREIGN PATENT DOCUMENTS

| | | | |
|---|---|---|---|
| CN | 1384415 | A | 12/2002 |
| CN | 1734538 | A | 2/2006 |

* cited by examiner

*Primary Examiner* — Jacob Y Choi
*Assistant Examiner* — Anthony Arpin
(74) *Attorney, Agent, or Firm* — Altis Law Group, Inc.

(57) ABSTRACT

An exemplary backlight control circuit for changing a brightness of a light source includes a coarse adjusting circuit and a fine adjusting circuit. The coarse adjusting circuit is configured to coarsely adjust a DC voltage according to one received coarse adjusting signal. The fine adjusting circuit is configured to finely adjust the DC voltage according to one received fine adjusting signal. A change of the DC voltage generated by the coarse adjusting circuit is greater than another change of the DC voltage generated by the fine adjusting circuit.

20 Claims, 8 Drawing Sheets

BACKLIGHT CONTROL CIRCUIT

FIELD OF THE INVENTION

The present disclosure relates to backlight control circuits, and particularly to backlight control circuits employing modulation pulse signals to adjust brightness of a display.

GENERAL BACKGROUND

Liquid crystal displays (LCDs) have the advantages of portability, low power consumption, and low radiation and been widely used in various portable information products such as notebooks, personal digital assistants (PDAs), video cameras, and the like. A typical LCD includes an LCD panel, a backlight for illuminating the LCD panel, and a backlight control circuit for controlling the backlight.

Referring to FIG. 9, one such backlight control circuit is shown. The backlight control circuit 10 includes a scalar circuit 12, a brightness adjusting button 11, a power circuit 13, and a light emitting diode (LED) 14. The power circuit 13 is configured to provide operational voltage to the scalar circuit 12. The scalar circuit 12 is configured to provide a direct current (DC) voltage to the LED 14.

The scalar circuit 12 includes a processing circuit 120, a pulse generating circuit 121, and an integral circuit 122.

Referring to FIG. 10, an exemplary on screen display (OSD) brightness adjusting menu employed by the backlight control circuit 10 is shown. The brightness adjusting button 11 is configured to adjust a brightness level of the LED 14. When the brightness adjusting button 11 is pressed down, a brightness adjusting signal is generated and sent to the processing circuit 120. The processing circuit 120 generates a brightness level according to the brightness adjusting signal and sends the brightness level to the pulse generating circuit 121. The pulse generating circuit 121 generates a pulse width modulation (PWM) signal according to the brightness level and a number of the brightness level of the brightness adjusting menu. For example, if the brightness level is equal to 6 and the number of the brightness level of the brightness adjusting menu is equal to 10, the pulse generating circuit 121 generates a PWM signal with a ratio of pulse width to the pulse period is 3:5.

The integral circuit 122 is configured to calculate and obtain a DC voltage according to the PWM signal, and provide the DC voltage to the LED 14 for adjusting the brightness of the LED 14.

Normally, the number of brightness level of the brightness adjusting menu is set large enough to adjust the brightness of the backlight precisely. The brightness of the backlight changes one level when the brightness adjusting button is pressed down once. Thus, a user needs to press the brightness adjusting button many times until the brightness of the backlight satisfies the user. For example, if the number of brightness level is equal to 50 and if brightness level of the backlight needs to be adjusted from level 1 to level 48, then the user needs to press the brightness adjusting button 47 times. Therefore the backlight control circuit 10 for adjusting the backlight is inefficient.

It is desired to provide a new backlight control circuit which can overcome the above-described deficiency.

SUMMARY

In an exemplary embodiment, a backlight control circuit for changing a brightness of a light source includes a coarse adjusting circuit and a fine adjusting circuit. The coarse adjusting circuit is configured to coarsely adjust a DC voltage according to one received coarse adjusting signal. The fine adjusting circuit is configured to finely adjust the DC voltage according to one received fine adjusting signal. A change of the DC voltage generated by the coarse adjusting circuit is greater than another change of the DC voltage generated by the fine adjusting circuit.

Other novel features and advantages will become more apparent from the following detailed description when taken in conjunction with the accompanying drawings.

DETAILED DESCRIPTION

Reference will now be made to the drawings to describe various embodiments of the present disclosure in detail.

Figure 1:
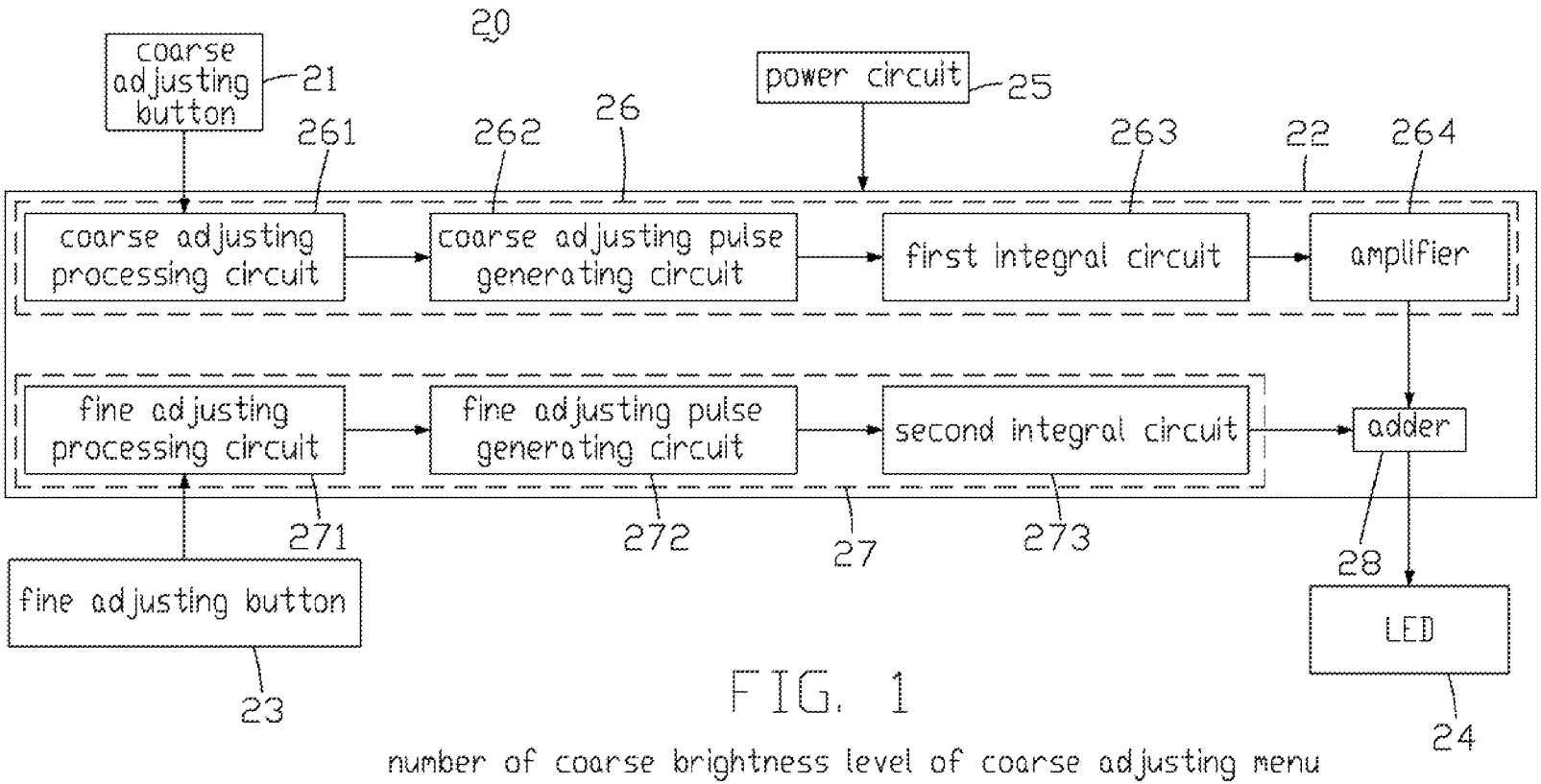
FIG. 1 is a block diagram of a backlight control circuit according to a first embodiment of the present disclosure.

Referring to FIG. 1, a block diagram of a backlight control circuit according to a first embodiment of the present disclosure is shown. In one embodiment, the backlight control circuit 20 includes a power circuit 25, a scalar circuit 22, a coarse adjusting button 21, a fine adjusting button 23, and an LED 24. The power circuit 25 is configured to provide operational voltage to the scalar circuit 22. The scalar circuit 22 is configured to provide a DC voltage to the LED. The coarse adjusting button 21 is configured to generate a coarse adjusting signal and provide the coarse adjusting signal to the scalar circuit 22 for coarsely adjusting brightness of the LED 24. The fine adjusting button 23 is configured to generate a fine adjusting signal and provide the fine adjusting signal to the scalar circuit 22 for finely adjusting brightness of the LED 24.

In one embodiment, the scalar circuit 22 includes a coarse adjusting circuit 26, a fine adjusting circuit 27, and an adder 28. The coarse adjusting circuit 26 is configured to receive the coarse adjusting signal from the coarse adjusting button 21 and coarsely adjust the DC voltage according to the coarse adjusting signal. The fine adjusting circuit 27 is configured to receive the fine adjusting signal from the fine adjusting button 23 and finely adjust the DC voltage according to the fine adjusting signal.

Figure 2:
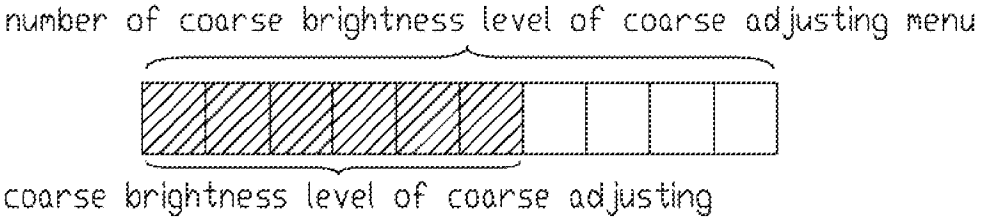
FIG. 2 is an exemplary OSD menu employed by the backlight control circuit of FIG. 1.

In one embodiment, the coarse adjusting circuit 26 includes a coarse adjusting processing circuit 261, a coarse adjusting pulse generating circuit 262, a first integral circuit 263, and an amplifier 264. The coarse adjusting processing circuit 261 receives the coarse adjusting signal from the coarse adjusting button 21 and generates a coarse brightness level according to the coarse adjusting signal and a pre-stored current brightness level, then provides the coarse brightness level to the coarse adjusting pulse generating circuit 262. The coarse adjusting pulse generating circuit 262 generates a coarse PWM signal according to the received coarse brightness level and a number of the coarse brightness level of a coarse adjusting menu such that a duty ratio of the coarse PWM signal is equal to a ratio of coarse brightness level to the number of the coarse brightness level. For example, FIG. 2 shows one exemplary embodiment of a coarse brightness level equal to 6 and a number of the coarse brightness level equal to 10. Accordingly, the coarse adjusting pulse generating circuit 262 generates a coarse PWM signal with a duty ratio of 3:5 (10:6). In other words, the ratio of pulse width of the coarse PWM signal to the pulse period of the coarse PWM signal is 3:5.

The first integral circuit 263 is configured to calculate and generate the coarse adjusting DC voltage according to the coarse PWM signal and provide the coarse adjusting DC voltage to the amplifier 264.

The amplifier 264 is configured to generate 5 times or 10 times coarse adjusting DC voltage, in one embodiment, and provide the 5 times or 10 times coarse adjusting DC voltage to the adder 28. In an alternative embodiment, the voltage outputted from the amplifier 264 can be adjusted to provide a predetermined number or range of coarse voltage adjustments. For example, the brightness may be set to change one level each time the coarse adjusting button 21 is pressed causing the coarse adjusting DC voltage to correspondingly change 0.1 volts. If the amplifier 264 amplifies the coarse adjusting DC voltage 10 times, the amplifier 264 may make the coarse adjusting DC voltage change 1.0 volts each time the coarse adjusting button is pressed.

The fine adjusting circuit 27 includes a fine adjusting processing circuit 271, a fine adjusting pulse generating circuit 272, and a second integral circuit 273. The fine adjusting processing circuit 271 receives the fine adjusting signal from the fine adjusting button 23 and generates a fine brightness level according to the fine adjusting signal, and provides the fine brightness level to the fine adjusting pulse generating circuit 272. The fine adjusting pulse generating circuit 272 generates a fine PWM signal according to the received fine brightness level and a number of the fine brightness level of a fine adjusting menu. A duty ratio of the fine PWM signal is equal to a ratio of fine brightness level to a number of the fine brightness level.

The second integral circuit 273 is configured to calculate and generate the fine adjusting DC voltage according to the fine PWM signal and provide the fine adjusting DC voltage to the adder 28.

In one embodiment, the adder may include a first memory (not shown), a second memory (not shown), and an addition circuit (not shown). The first memory stores the amplified coarse adjusting DC voltage each time the coarse adjusting button 21 is pressed. The second memory stores the fine adjusting DC voltage each time the fine adjusting button 23 is pressed. The addition circuit is configured to read the fine adjusting DC voltage and the coarse adjusting DC voltage from the first and second memories respectively and sum both voltages together when the coarse adjusting button 21 or the fine adjusting button 23 is pressed. Finally, the adder 28 provides a sum of the fine adjusting DC voltage and the coarse adjusting DC voltage to the LED 24 so as to adjust the brightness of the LED 24.

For example, the coarse brightness level may change one level when the coarse adjusting button 21 is pressed once causing the coarse adjusting DC voltage to change 1.0 volts. The fine brightness level may change one level when the fine adjusting button 23 is once pressed causing the fine adjusting DC voltage to changes 0.1 volt. Thus, one coarse brightness level is approximately equal to ten fine brightness levels. In other words, to obtain a same brightness change, the fine adjusting button 23 needs to be pressed 10 times more than the coarse adjusting button 21.

If a DC voltage for driving the LED 24 needs to be changed 3.5 volts, the user can press the coarse adjusting button 21 three times and the fine adjusting button 23 five times, but in a typical backlight control circuit, the user press adjusting button thirty-five times.

Because the backlight control circuit 20 includes the coarse adjusting circuit 22 for coarsely adjusting the brightness of a display and the fine adjusting circuit 27 for finely adjusting the brightness of the display, the brightness of the backlight can he quickly and precisely adjusted to a desired level.

Figure 3:
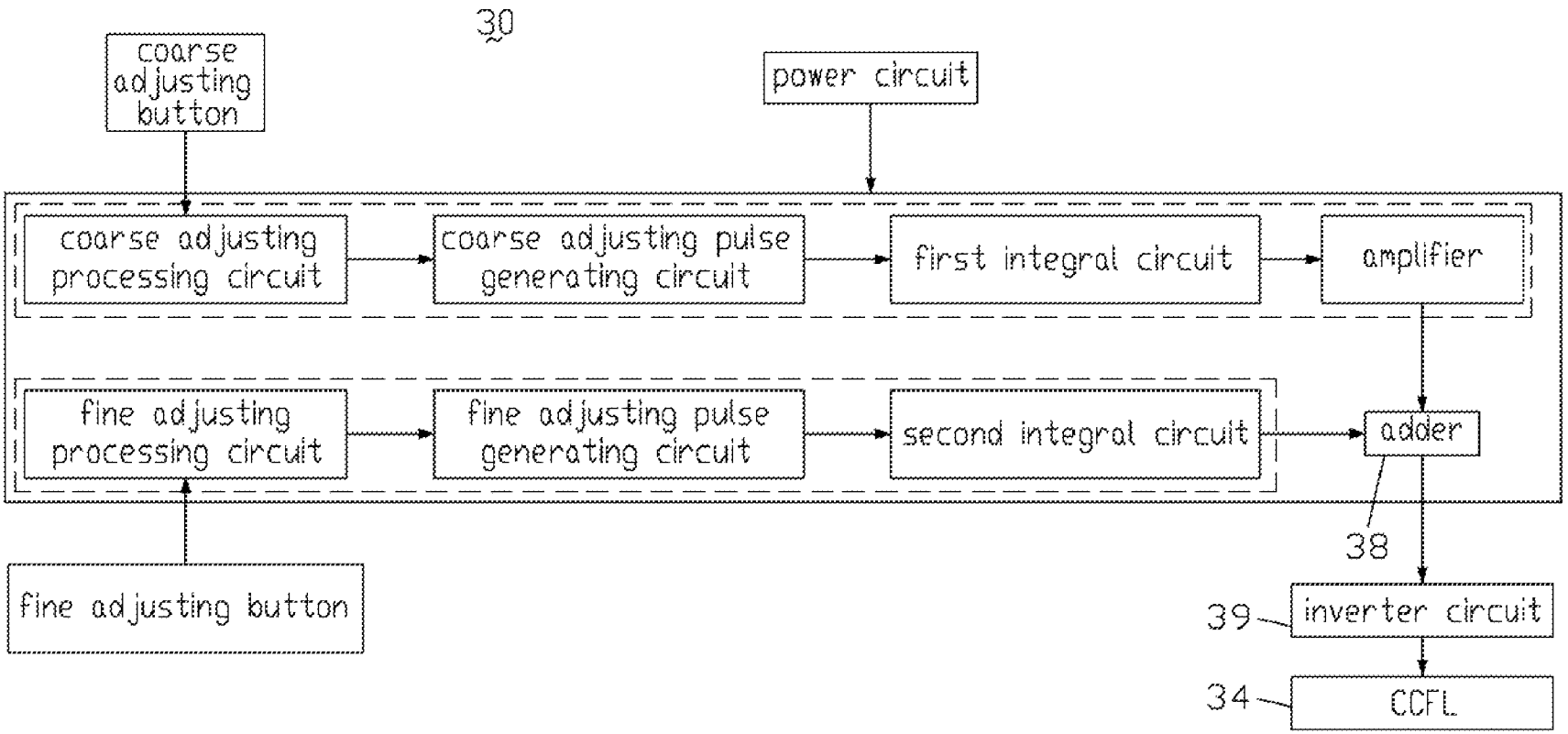
FIG. 3 is a block diagram of a backlight control circuit according to a second embodiment of the present disclosure.

Referring to FIG. 3, a block diagram of a backlight control circuit according to a second embodiment of the present disclosure is shown. The backlight control circuit 30 may be substantially similar to the backlight control circuit 20 except that the backlight control circuit 30 further includes a cold cathode fluorescent lamp (CCFL) 34 and an inverter circuit 39. The CCFL 34 is configured to replace the LED 24. The inverter circuit 39 is configured to receive a DC voltage from the adder 38 and transform the DC voltage into an alternating current (AC) voltage to drive the CCFL 34.

Figure 4:
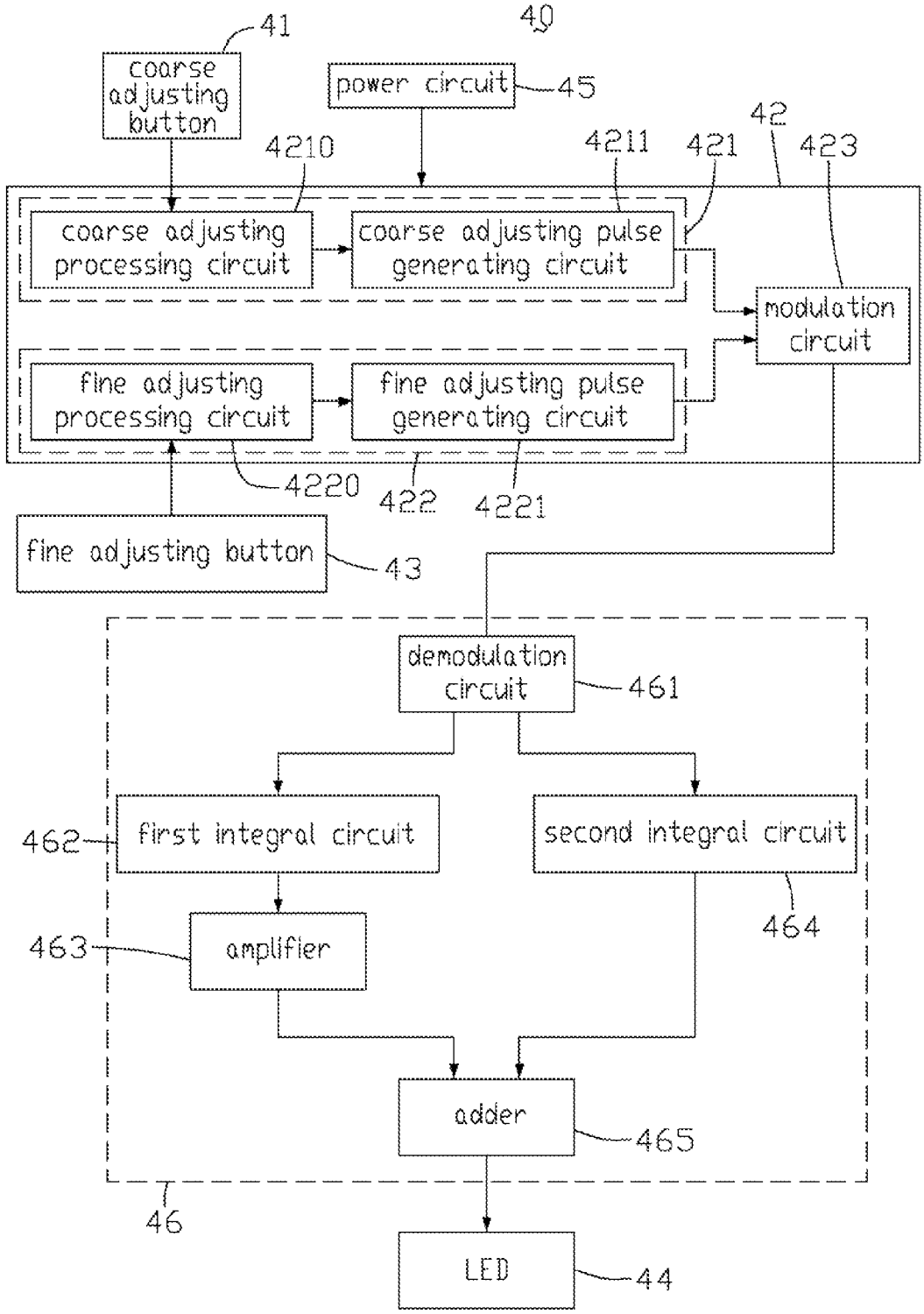
FIG. 4 is a block diagram of a backlight control circuit according to a third embodiment of the present disclosure.

Referring to FIG. 4, a block diagram of a backlight control circuit according to a third embodiment of the present disclosure is shown. The backlight control circuit 40 includes a power circuit 45, a scalar circuit 42, a coarse adjusting button 41, a fine adjusting button 43, a backlight driving circuit 46 and an LED 44. The power circuit 45 is configured to provide operational voltage to the scalar circuit 42. The scalar circuit 42 is configured to generate a DC voltage. The coarse adjusting button 41 is configured to generate a coarse adjusting signal and provide the coarse adjusting signal to the scalar circuit 42 for coarsely adjusting brightness of the LED 44. The fine adjusting button 43 is configured to generate a fine adjusting signal and provide the fine adjusting signal to the scalar circuit 42 for finely adjusting brightness of the LED 44.

The scalar circuit 42 includes a coarse adjusting circuit 421, a fine adjusting circuit 422, and a modulation circuit 423.

The coarse adjusting circuit 421 includes a coarse adjusting processing circuit 4210 and a coarse adjusting pulse generating circuit 4211. The coarse adjusting processing circuit 4210 receives the coarse adjusting signal and generates a coarse brightness level according to the coarse adjusting signal and a pre-stored current brightness level, then provides the coarse brightness level to the coarse adjusting pulse generating circuit 4211. The coarse adjusting pulse generating circuit 4211 generates a coarse PWM signal according to the received coarse brightness level and a number of the coarse brightness level. A duty ratio of the coarse PWM signal is equal to a ratio of coarse brightness level to the number of the coarse brightness level.

The fine adjusting circuit 422 includes a fine adjusting processing circuit 4220 and a fine adjusting pulse generating circuit 4221. The fine adjusting processing circuit 4220 receives the fine adjusting signal and generates a fine brightness level according to the fine adjusting signal, and provides the fine brightness level to the fine adjusting pulse generating circuit 4221. The fine adjusting pulse generating circuit 4221 generates a fine PWM signal according to the received fine brightness level and a number of the fine brightness level. A duty ratio of the fine PWM signal is equal to the ratio of the fine brightness level to the number of the fine brightness level.

Figure 5:
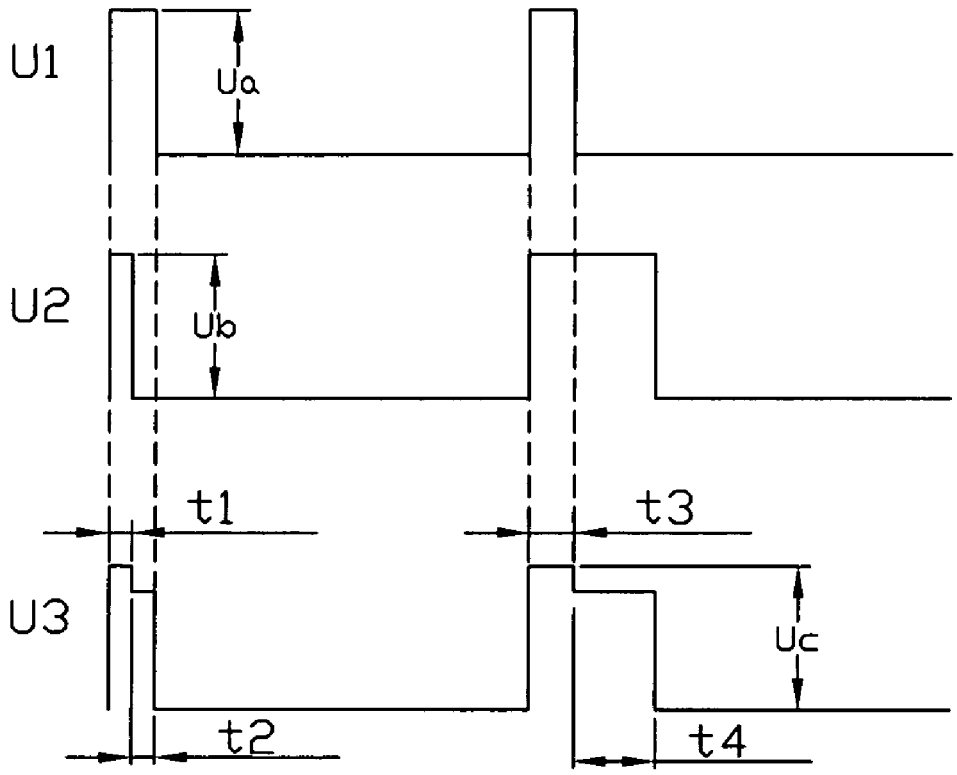
FIG. 5 is a wave diagram showing one embodiment of a method for modulating a fine PWM signal and a coarse PWM signal generated in FIG. 4.

The modulation circuit 423 is configured to modulate the fine PWM signal and the coarse PWM signal into a mixed PWM signal and provide the mixed PWM signal to the backlight driving, circuit 46. Referring to FIG. 5, one embodiment of a method for modulating the fine PWM signal and the coarse PWM signal is shown. In the embodiment of FIG. 5, U3 denotes the mixed PWM signal of the modulation of the fine PWM signal and the coarse PWM signal. It may be understood that periods and phases of the coarse adjusting pulse signal U1, the fine adjusting signal U2 and the mixed PWM signal U3 may be substantially the same. It may be further understood that amplitudes of the coarse adjusting pulse signal U1, the fine adjusting signal U2 and the mixed PWM signal U3 are different with one another. In a first time t1, a first pulse of the mixed PWM signal U3 is formed with a predetermined amplitude Uc when the pulse signals U1, U2 are provided to the modulation circuit 423. in a second time t2, a second pulse of the mixed PWM signal U3 is formed with an first amplitude Ua when only the pulse signal U1 is provided to the modulation circuit 423. In a third time t3, a third pulse of the mixed PWM signal U3 is formed with the predetermined amplitude Uc when the pulse signals U1. U2 are provided to the modulation circuit 423. In a fourth time t4, a fourth pulse of the mixed PWM signal U3 is formed with an second amplitude Ub when only the pulse signal U2 is provided to the modulation circuit 423. The amplitudes of the coarse adjusting pulse signal U1 and the fine adjusting signal. U2 are equal to Ua and Ub, respectively, where Ua does not equal Ub and where Ub and Ua are less than Uc.

In one embodiment, the backlight driving circuit 46 includes a demodulation circuit 461, a first integral circuit 462, an amplifier 463, a second integral circuit 464, and an adder 465. The demodulation circuit 461 is configured to receive the mixed PWM signal U3 and demodulate the mixed PWM signal U3 into the coarse PWM signal and the fine PWM signal.

The first integral circuit 462 is configured to calculate and generate a coarse adjusting DC voltage according to the coarse PWM signal from the demodulation circuit 461 and provide the coarse adjusting DC voltage to the amplifier 463. The amplifier 264 is configured to amplify the coarse adjusting DC voltage and provide the amplified coarse adjusting DC voltage to adder 465.

The second integral circuit 464 is configured to calculate and generate a fine adjusting DC voltage according to the fine PWM signal from the demodulation circuit 461 and provide the fine adjusting DC voltage to the adder 465.

The adder is configured to receive the fine adjusting DC voltage and the amplified coarse adjusting DC voltage and sum them when the coarse adjusting button 41 or the fine adjusting button 43 is pressed. Finally, the adder 28 provides a sum of the fine adjusting DC voltage and the amplified coarse adjusting DC voltage to the LED 44 for adjusting the brightness of the LED 44.

Figure 6:
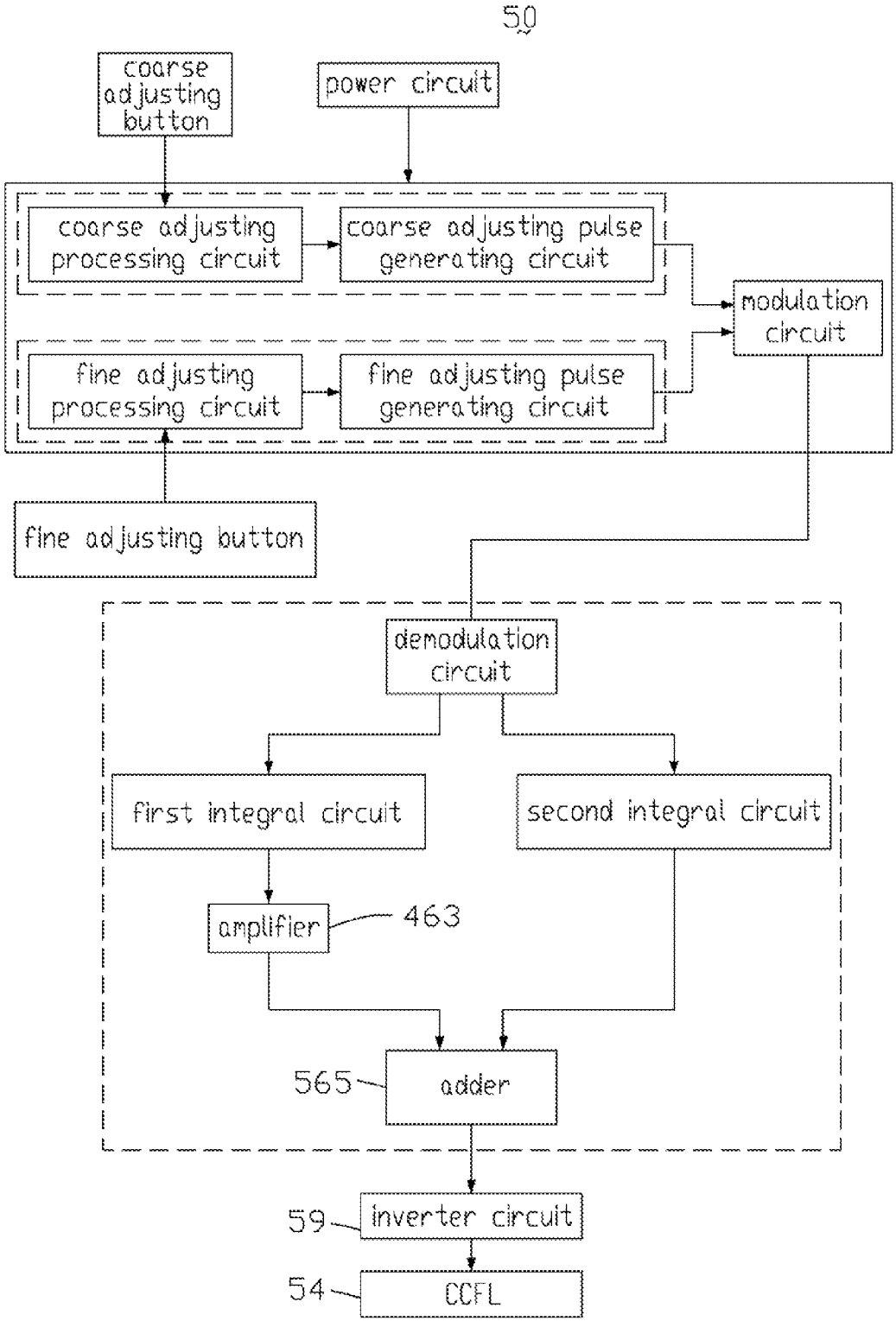
FIG. 6 is a block diagram of a backlight control circuit according to a fourth embodiment of the present disclosure.

Referring to the FIG. 6, a block diagram of a backlight control circuit according to a fourth embodiment of the present disclosure is shown. The backlight control circuit 50 may be substantially similar to the backlight control circuit 40 except that the backlight control circuit 50 further includes a CCFL 54 and an inverter circuit 59. The CCFL 54 is configured to replace the LED 44. The inverter circuit 59 is configured to receive a DC voltage from the adder 465 and transform the DC voltage into an AC voltage to drive the CCFL 54.

Figure 7:
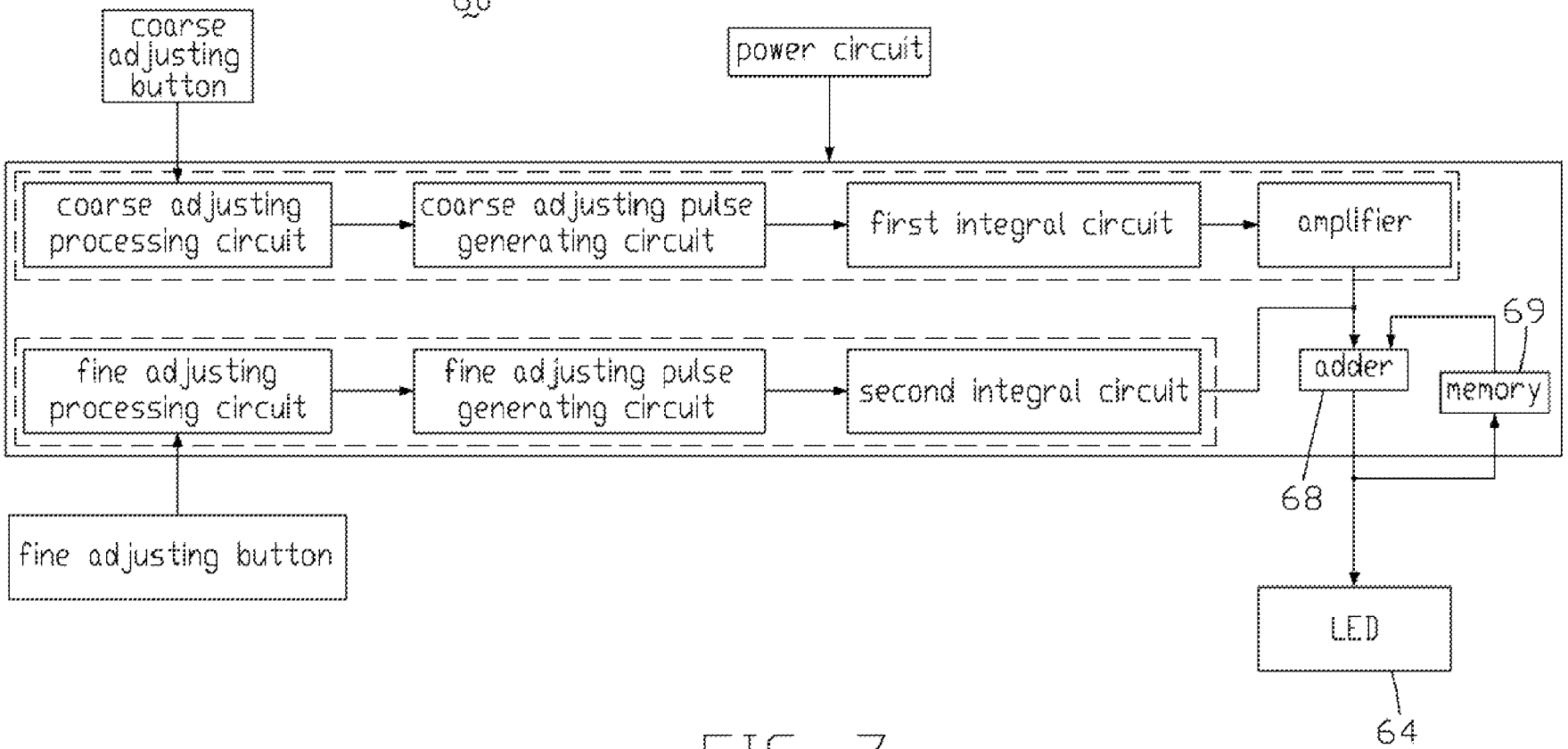
FIG. 7 is a block diagram of a backlight control circuit according to a fifth embodiment of the present disclosure.

Referring to FIG. 7, a block diagram of circuits of a backlight control circuit according to a fifth embodiment of the present disclosure is shown. The backlight control circuit 60 may be substantially similar to the backlight control circuit 20 except that the backlight control circuit 60 further includes a memory 69. The memory 69 is configured to pre-store a current DC driving voltage for driving the LED 64 and provide the current DC driving voltage to the adder 68. The adder 68 is configured to sum the current DC driving voltage and an amplified coarse adjusting DC voltage or/and a fine adjusting DC voltage and send a sum of them to the LED 64 for adjusting the brightness of the LED 64.

Figure 8:
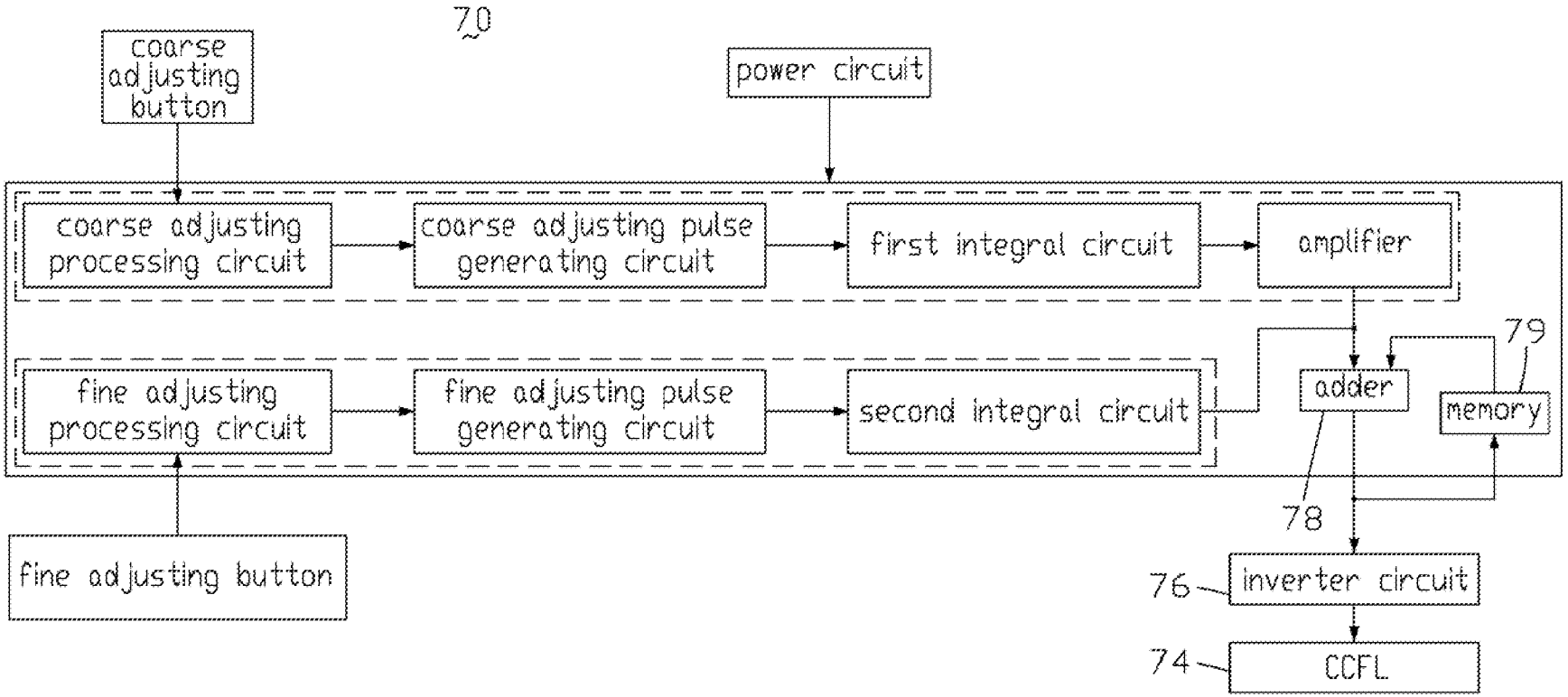
FIG. 8 is a block diagram of a backlight control circuit according to a sixth embodiment of the present disclosure.
Figure 9:
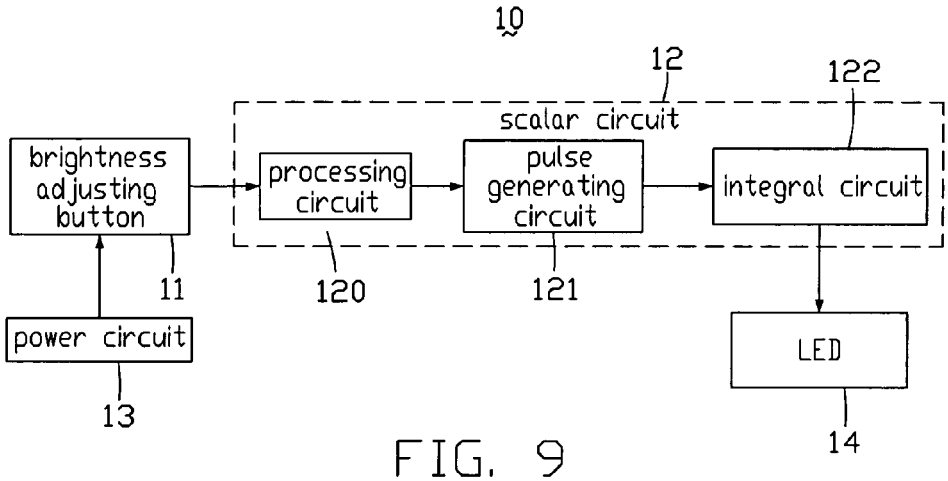
FIG. 9 (RELATED ART)
FIG. 9 is a block diagram of a backlight control circuit.
Figure 10:
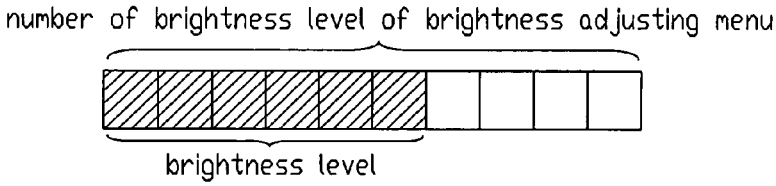
FIG. 10 (RELATED ART)
FIG. 10 is an exemplary OSD brightness adjusting menu employed by the backlight control circuit of FIG. 9.

Referring to FIG. 8, a block diagram of a backlight control circuit according to a sixth embodiment of the present disclosure is shown. The backlight control circuit 70 may be substantially similar to the backlight control circuit 30 except that the backlight control circuit 70 further includes a memory 79. The memory 79 is configured to pre-store a current DC driving voltage and provide the current DC driving voltage to the adder 78. The adder 78 is configured to sum the current DC driving voltage and an amplified coarse adjusting DC voltage and/or a fine adjusting DC voltage and send a sum of them to an inverter circuit 76 for adjusting the brightness of a CCFL 74.

It is to be understood, however, that even though numerous characteristics and advantages of the embodiments have been set out in the foregoing description, together with details of the structures and functions of the embodiments, the disclosure is illustrative only; and that changes may be made in detail, especially in matters of arrangement of parts within the principles of present disclosure to the full extent indicated by the broad general meaning of the terms in which the appended claims are expressed.

What is claimed is:

1. A backlight control circuit for changing a brightness of a light source comprising:

a coarse adjusting circuit configured to coarsely adjust a DC voltage according to a received coarse adjusting signal and generate a corresponding coarse PWM signal;

a fine adjusting circuit configured to finely adjust the DC voltage according to a received fine adjusting signal and generate a corresponding fine PWM signal;

a coarse adjusting button configured for generating the coarse adjusting signal and providing the coarse adjusting signal to the coarse adjusting circuit;

a fine adjusting button configured for generating the fine adjusting signal and providing the fine adjusting signal to the fine adjusting circuit;

a modulation circuit configured to modulate the fine PWM signal and the coarse PWM signal into a mixed PWM signal; and a backlight driving circuit for receiving the mixed PWM signal and driving the light source according to the mixed PWM signal.

2. The backlight control circuit of claim 1, wherein the coarse adjusting. circuit comprises a coarse adjusting processing circuit and a coarse adjusting pulse generating circuit, the coarse adjusting processing circuit configured to generate a coarse brightness level according to the received coarse adjusting signal, the coarse adjusting pulse generating circuit configured to generate the coarse PWM signal such that a duty ratio of the coarse PWM signal is equal to a ratio of the coarse brightness level to a number of all coarse brightness level .

3. The backlight control circuit of claim 2 ,wherein the fine adjusting circuit comprises a fine adjusting processing circuit and a fine adjusting pulse generating circuit, the fine adjusting processing circuit configured to generate a fine brightness level according to the fine adjusting signal and provide the fine brightness level to the fine adjusting pulse generating circuit, the fine adjusting pulse generating circuit configured to generate the fine PWM signal such that a duty ratio of the fine PWM signal is equal to a ratio of fine brightness level to a number of all fine brightness level.

4. The backlight control circuit of claim 1, wherein the backlight driving circuit comprises:

a demodulation circuit configured to demodulate the mixed PWM signal into the coarse PWM signal and the fine PWM signal;

a first integral circuit configured to generate a coarse adjusting DC voltage according to the coarse PWM signal;

an amplifier configured to amplify the coarse adjusting DC voltage;

a second integral circuit configured to generate a fine adjusting DC voltage according to the fine PWM signal; and an adder configured to calculate a sum of the fine adjusting DC voltage and the amplified coarse adjusting DC voltage and provide the sum to the light source.

5. The backlight control circuit of claim 1, wherein the backlight driving circuit comprises:

a demodulation circuit configured to demodulate the mixed PWM signal into the coarse PWM signal and the fine PWM signal;

a first integral circuit configured to generate a coarse adjusting DC voltage according to the coarse PWM signal;

an amplifier configured to amplify the coarse adjusting voltage;

a second integral circuit configured to generate a fine adjusting DC voltage according to the fine PWM signal;

a memory configured to pre-store a current DC driving voltage; and an adder configured to calculate a sum of the current DC driving voltage and at least one item selected from the group consisting of the fine adjusting DC voltage and the amplified coarse adjusting DC voltage.

6. The backlight control circuit of claim 5, further comprising an inverter circuit configured to generate an alternative voltage according to the sum from the adder.

7. The backlight control circuit of claim 1, wherein the received coarse adjusting, signal adjusts the DC voltage by 1.0 volts and wherein the received fine adjusting signal adjusts the DC voltage by 0.1 volts.

8. A backlight control circuit for changing a brightness of a light source comprising:

a coarse adjusting circuit configured to coarsely adjust a DC voltage according to a received coarse adjusting signal;

a fine adjusting circuit configured to finely adjust the DC voltage according to a received fine adjusting signal;

a coarse adjusting button configured for generating the coarse adjusting signal and providing the coarse adjusting signal to the coarse adjusting circuit;

a fine adjusting button configured for generating the fine adjusting signal and providing the fine adjusting signal to the fine adjusting circuit;

wherein a change of the DC voltage generated by the coarse adjusting circuit is greater than another change of the DC voltage generated by the fine adjusting circuit;

wherein the coarse adjusting circuit comprise a coarse adjusting processing circuit , a coarse adjusting pulse generating circuit, a first integral circuit, and an amplifier, the coarse adjusting processing circuit configured to generate a coarse brightness level according to the received coarse adjusting signal, the coarse adjusting pulse generating circuit configured to generate a coarse PWM signal such that a duty ratio of the coarse PWM signal is equal to a ratio of the coarse brightness level to a number of all coarse brightness level , the first integral circuit configured to generate a coarse adusting DC voltage according to the coarse PWM signal the amplifier configured to amplify the coarse adjusting DC voltage.

9. The backlight control circuit of claim 8, wherein the fine adjusting circuit comprises a fine adjusting processing circuit, a fine adjusting pulse generating circuit, and a second integral circuit, the fine adjusting processing circuit configured to generate a fine brightness level according to the fine adjusting signal and provide the fine brightness level to the fine adjusting pulse generating circuit, the fine adjusting pulse generating circuit-configured to generate a fine PWM signal such that a duty ratio of the fine PWM signal is equal to a ratio of fine brightness level to a number of all fine brightness level, the second integral circuit configured to generate a fine adjusting DC voltage according to the fine PWM signal.

10. The backlight control circuit of claim 9, further comprising an adder configured to calculate a sum of the fine adjusting DC voltage and the amplified coarse adjusting DC voltage and provide the sum to the light source.

11. The backlight control circuit of claim 10, wherein the adder, the fine adjusting circuit, and the coarse adjusting circuit are integrated to he a scalar circuit.

12. The backlight control circuit of claim 9, further comprising an adder and a memory configured to pre-store a current DC driving voltage and provide the current DC driving voltage to the adder, wherein the adder is configured to calcutate a sum of the current DC driving voltage and at least one item selected from the group consisting of the amplified coarse adjusting DC voltage and the fine adjusting DC voltage.

13. The backlight control circuit of claim 12, further comprising an inverter circuit configured to generate an alternative voltage according to the sum of the current DC driving voltage and the amplified coarse adjusting DC voltage and the fine adjusting DC voltage.

14. A backlight control circuit for changing a brightness of a light source comprising:

a coarse adjusting circuit configured to coarsely adjust a DC voltage according to a received coarse adjusting signal;

a fine adjusting circuit configured to finely adjust the DC voltage according to a received fine adjusting signal;

a coarse adjusting button configured for generating the coarse adjusting signal and providing the coarse adjusting signal to the coarse adjusting circuit; and a fine adjusting button configured for generating the fine adjusting signal and providing the fine adjusting signal to the fine adjusting circuit wherein the fine adjusting circuit comprises a fine adjusting processing circuit, a fine adjusting pulse generating circuit, and a first integral circuit, the fine adjusting processing circuit configured to generate a fine brightness level according to the fine adjusting signal and provide the fine brightness level to the fine adjusting pulse generating circuit, the fine adjusting pulse generating circuit configured to generate a fine PWM signal such that a duty ratio of the fine PWM signal is equal to a ratio of fine brightness level to a number of all fine brightness level, the first integral circuit configured to generate a fine adjusting DC voltage according to the fine PWM signal.

15. The backlight control circuit of claim 14, wherein the coarse adjusting circuit comprises a coarse adjusting processing circuit, a coarse adjusting pulse generating circuit , a second integral circuit, and an amplifier, the coarse adjusting processing circuit configured to generate a coarse brightness level according to the received coarse adjusting signal, the coarse adjusting pulse generating circuit configured to generate a coarse PWM signal such that a duty ratio of the coarse PWM signal is equal to a ratio of the coarse brightness level to a number of all coarse brightness level, the second integral circuit configured to generate a coarse adjusting DC voltage according to the coarse PWM signal, the amplifier configured to amplify the coarse adjusting DC voltage.

16. The backlight control circuit of claim 15,further comprising, an adder configured to calculate a sum of the fine adjusting DC voltage and the amplified coarse adjusting DC voltage and provide the sum to the light source.

17. The backlight control circuit of claim 16, wherein the adder, the fine adjusting circuit, and the coarse adjusting circuit are integrated to be a scalar circuit.

18. The backlight control circuit of claim 17, further comprising an adder and a memory configured to pre-store a current DC driving voltage and provide the current DC driving voltage to the adder, wherein the adder is configured to calculate a sum of the current DC driving voltage and at least one item selected from the group consisting of the amplified coarse adjusting DC voltage and the fine adjusting DC voltage.

19. The backlight control circuit of claim 18, further comprising an inverter circuit configured to generate an alternative voltage according to the sum of the current DC driving voltage and an amplified coarse adjusting DC voltage and the fine adjusting DC voltage.

20. The backlight control circuit of claim 14, wherein a change of the DC voltage generated by the coarse adjusting circuit is greater than another change of the DC voltage generated by the fine adjusting circuit.

* * * * *